United States Patent [19]

Brown

[11] Patent Number: 4,958,446

[45] Date of Patent: Sep. 25, 1990

[54] FOOTWEAR AND ADAPTION THEREOF FOR PRODUCTION OF ADVERTISING MESSAGE

[76] Inventor: James G. Brown, 44 Harding Boulevard, Scarborough, Ontario, Canada, M1N 3C9

[21] Appl. No.: 262,580

[22] Filed: Oct. 26, 1988

[51] Int. Cl.[5] ..... A43B 3/12

[52] U.S. Cl. ..... 36/11.5; 36/1; 36/30 R

[58] Field of Search ..... 36/1, 11.5, 25 R, 30 R, 36/7.5, 7.6, 8.1

[56] References Cited

U.S. PATENT DOCUMENTS

| | | | |
|---|---|---|---|
| 2,754,598 | 7/1956 | Aull | 36/1 |
| 4,030,212 | 6/1977 | Ito | 36/11.5 |
| 4,050,168 | 9/1977 | Pace | 36/30 R |

FOREIGN PATENT DOCUMENTS

| | | | |
|---|---|---|---|
| 171697 | 2/1986 | European Pat. Off. | 36/1 |

*Primary Examiner*—Werner H. Schroeder
*Assistant Examiner*—Diana L. Biefeld
*Attorney, Agent, or Firm*—Sim & McBurney

[57] ABSTRACT

A disposable sandal is adapted to apply an advertising message repeatedly into sandy soil at a beach or the like. The sandal is formed of sheet material, and a pair of blind-ended slits in the sheet material define an elongate stem and a strap integral with and extending to either side of the stem. The sheet material is sufficiently flexible that the stem and strap can be raised by hand from the general plane of the sheet material. The stem is received between the wearer's toes and the strap is fitted over the wearer's foot to retain the sandal. The sandal has a lower exposed surface with projections defining a mirror image of the advertising message. The projections are sufficiently large that the advertising message is stamped repeatedly into the soil in a form intelligible to the unassisted human eye, as the wearer walks.

4 Claims, 2 Drawing Sheets

FOOTWEAR AND ADAPTION THEREOF FOR PRODUCTION OF ADVERTISING MESSAGE

FIELD OF THE INVENTION

The invention relates generally to advertising, and more particularly, to footwear for use in conveying an advertising message in a novel manner and to inexpensive construction of such footwear.

BACKGROUND OF THE INVENTION

Advertisers attempt constantly to find novel media for conveying advertising messages. In the past one has seen advertisements placed on "sandwich" boards worn by persons strolling the streets, advertising messages trailed behind aircraft, dirigibles bearing the trade marks of major product suppliers, and other innovative advertising media.

It is one object of the present invention to provide a novel advertising medium and apparatus for effecting advertisements in such a medium.

BRIEF SUMMARY OF THE INVENTION

In one aspect, the invention provides apparatus for applying an advertising message repeatedly into soil. The apparatus comprises a shoe having a sole with a lower exposed surface, and projections extending from the lower exposed surface and defining a mirror image of the advertising message. The projections are sufficiently large that the advertising message is stamped repeatedly into the soil as a person wearing the shoe walks and is intelligible to the human eye. The shoes are most conveniently disposable sandals which can be affordably given away to individuals as promotional items. Such sandals might typically be worn at a beach and would leave an intelligible advertising message in the sand with each step taken. The advertising message might typically comprise a known trade mark in word, logo or combined form.

In another aspect, the invention provides a very simple sandal construction which lends itself to inexpensive production of the advertising apparatus of the invention. A sandal is formed of sheet material with a pair of opposing faces and a peripheral side edge. A pair of blind-ended slits are formed in a forward portion of the sheet material inset from the peripheral side edge and extend between the opposing faces. The slits are shaped to define in the sheet material a stem with a forward stem portion and a rear stem portion and to define a strap integral with the forward stem portion and extending laterally to either side of the forward stem portion. The sheet material is sufficiently flexible that that the stem and strap can be raised by hand from the general plane of the sheet material. The stem is dimensioned to be received between the toes of a wearer's foot and the strap is shaped to overlay the wearer's foot and to retain the sandal to the wearer's foot.

The sheet material may be of laminated construction. A lower layer may be formed of a durable synthetic material integrally molded with projections defining a mirror image message of the type contemplated above. An upper layer may be formed of a foam material to provide wearing comfort. For use solely as a sandal without advertising aspects, the sheet material may be of homogeneous construction and may be formed of any suitable resilient or flexible substance.

Various aspects of the invention will be defined in greater detail in the appended claims.

DESCRIPTION OF THE DRAWINGS

The invention will be better understood with reference to drawings illustrating a preferred embodiment, in which.

DESCRIPTION OF THE PREFERRED EMBODIMENT

Figure 1:
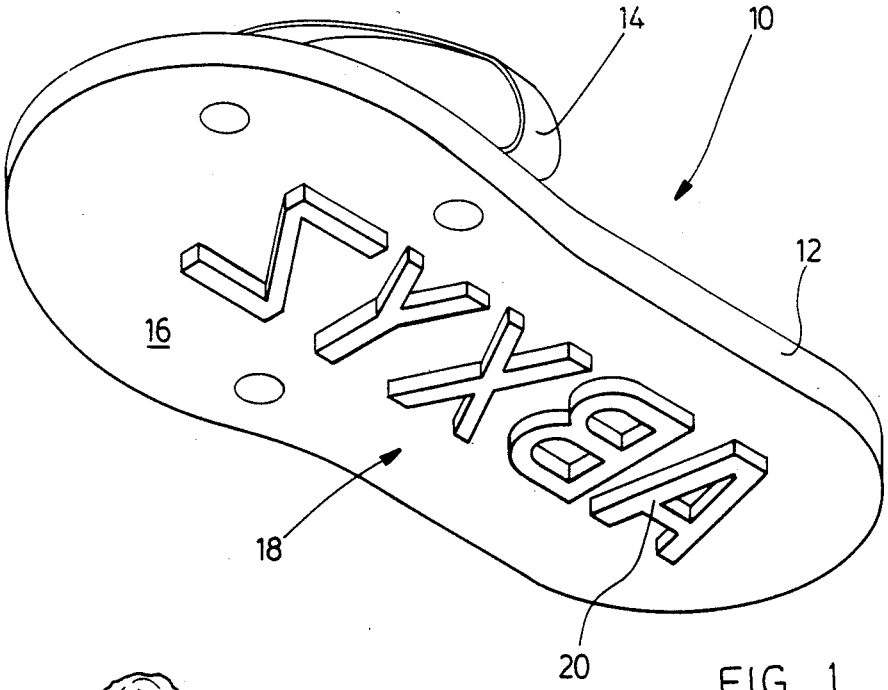
FIG. 1 is a perspective view of a sandal embodying the present invention.

Reference is made to FIG. 1 which illustrates a sandal 10 with a sole 12 and straps 14 by means of which the sandal 10 can be secured to a wearer's foot. The lower exposed surface 16 of the sole 12 is integrally molded with projections 18 defining a mirror image advertising message. In this instance, the message consists of letters defining the well known trade mark PEPSI.

It is necessary to ensure that the advertising message is properly stamped into soil and intelligible to others. The projections 18 must extend sufficiently from the lower exposed surface 16 of the sole 12 and must have sufficient lateral extent (that is, dimensions parallel to the plane of the exposed lower surface 16) that the soil does not immediately refill the stamped message. The projection 20 defining the mirror image of the letter "P" might, for example, extend about one-quarter inch outwardly from the exposed lower surface 16 of the sole 12 and would have a lateral width of about three-eighths of an inch along most of the letter. The projections 18 should be sufficiently large that the stamped advertising message is intelligible to the unassisted human eye at distances greater than 5 feet thereby permitting individuals to spot and understand the message as they walk by. For purposes of the specification and the appended claims, this expression "intelligible to the unassisted human eye" should be understood as meaning that the stamped message can be understood or appreciated upon visual inspection by a person of average eyesight without visual aids.

Figure 2:
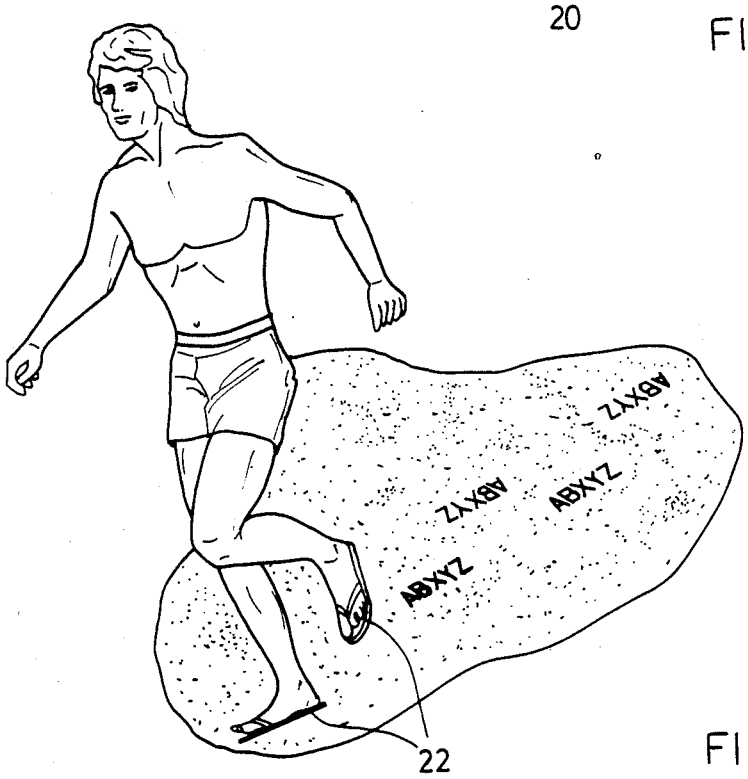
FIG. 2 illustrates an individual wearing sandals of the type in FIG. 1 and the general nature of the advertising message produced as the individual walks along a beach.

The manner in which such a sandal can be used to convey an advertising message will be apparent in FIG. 2 where an individual is shown wearing a pair 22 of such sandals. As the individual walks along a beach, the advertising message PEPSI is stamped repeatedly along the sand, as diagrammatically illustrated.

The general object in constructing the sandals 22 will be to reduce their cost sufficiently that they might be given away as promotional beach wear. An inexpensive sandal construction which can be adapted for purposes of producing advertising messages of the present invention is described in U.S. Pat. No. 4,030,212 which issued on Jun. 21, 1977 to Kakutaro Ito. However, it is one object of the present invention to provide an even simpler sandal construction. Such a sandal construction adapted for the purposes of producing advertising messages is illustrated in FIGS. 3 and 4.

Figure 4:
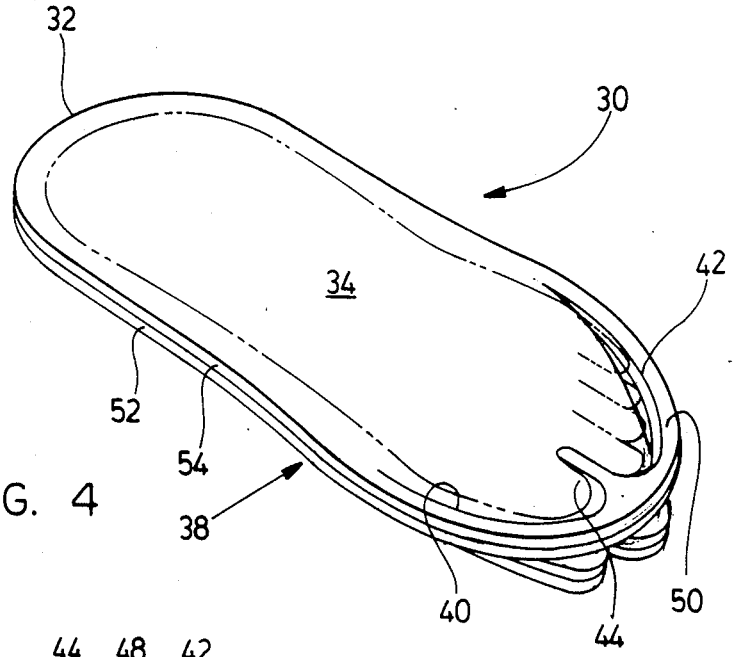
Figure 3:
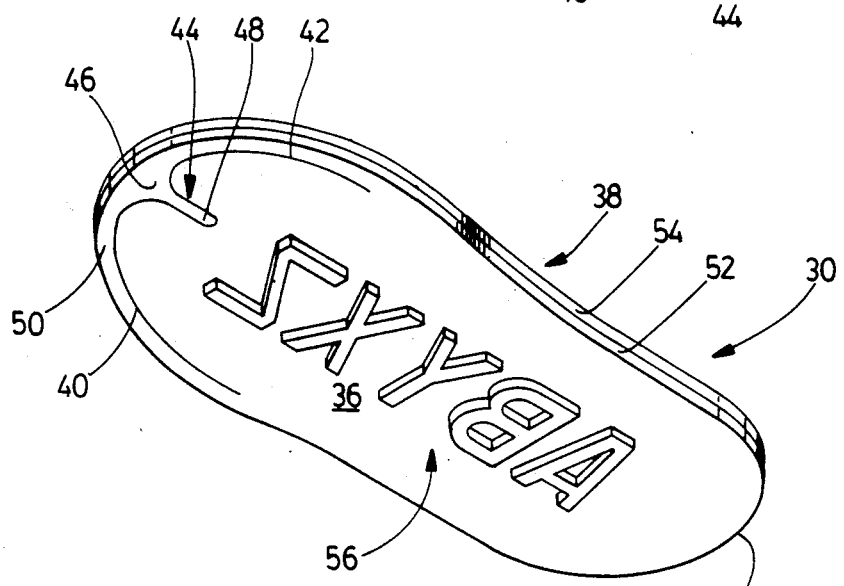
FIG. 3 is a perspective view from below of another sandal embodying the invention and also a preferred sandal construction; and, FIG. 4 is a perspective view from above of the sandal of FIG. 3 with portions thereof raised to receive a wearer's foot.

FIGS. 3 and 4 illustrate a sandal 30 formed of laminated sheet material 32 with a pair of opposing faces 34, 36 and a peripheral side edge 38 in shoe sole configuration, that is, in the general configuration of the sole of a shoe including the heel area. A pair of blind-ended arcuate slits 40, 42 are formed in a forward portion of the sheet material 32 inset from the peripheral side edge 38 and extend fully between the pair of opposing faces 34, 36. The term "blind-ended" as in this specification should be understood as meaning that the slits 40, 42 terminate within the sheet material 32 itself rather than extending to and opening at the peripheral edge.

The slits 40, 42 are shaped to define an elongate stem 44 with a forward stem portion 46 and a rear stem portion 48. They also define in the sheet material 32 a strap 50 integral with the forward stem portion 46 and extending laterally to either side of the forward stem portion 46. The sheet material 32 is sufficiently flexible that the stem 44 and strap 50 can be raised by hand from the general plane of the sheet material 32 as apparent in FIG. 4. This is done in large measure by pivoting the stem 44 upwardly about the rear stem end portion which forms an integral hinge with the rest of the sheet material 32. The stem 44 is dimensioned to be received between the toes of a wearer's foot. The strap 50 is shaped to overlay the wearer's foot and to retain the sandal 30 to the wearer's foot when the stem 44 is received between the wearer's toes. Because blind-ended slits are used to define the stem 44 and strap 50, the strap 50 remains integrally connected at opposite sides of the sandal 30 to the rest of the sheet material 32.

The sheet material 32 may comprise a lower layer 52 formed of recycled polyvinylchloride. An upper layer 54 of foamed synthetic material can be bonded with an appropriate adhesive to the lower layer 52 to provide a measure of wearing comfort. The lower layer 52 may be molded with projections 56 of the same general configuration as the projections 18 described above and defining a mirror image message to be stamped into soil.

Sandals of the configuration of the sandal 30 with a reverse image advertising message may be constructed in volume in the following manner. A sheet of polyvinylchloride may be molded with the mirror image of the advertising message repeated and appropriately spaced over a lower surface of the sheet. An upper layer of foam material can then be adhesively bonded to the opposing upper surface of the polyvinylchloride sheet. The sheet material so constructed can then be die cut to define a multiplicity of sandals and to introduce paired slits of the configuration illustrated in FIGS. 3 and 4. Polyvinylchloride has been specified since recycled polyvinylchloride is comparatively inexpensive. Any appropriate moldable material might be substituted.

It will be appreciated that particular embodiments of the invention has been described and that modifications may be made therein without departing from the spirit of the invention and the scope of the appended claims. In particular, the footwear of the invention might be used as a novelty item to stamp intriguing messages such as "Follow Me" with each step taken along a beach or the like.

I claim:

1. A sandal formed of sheet material with a pair of opposing faces and a peripheral side edge, a pair of blind-ended slits being formed in a forward portion of the sheet material inset from the peripheral side edge and extending between the opposing faces, the slits being shaped to define in the sheet material an elongate stem with a forward stem portion and a rear stem portion which is hinged to the rest of the sheet material and to define in the sheet material a strap integral with the forward stem portion and extending laterally to either side of the forward stem portion, the sheet material being sufficiently flexible that the stem and strap can be raised by hand from the general plane of the sheet material, the stem being dimensioned to be received between the toes of a wearer's foot and the strap being shaped to overlay the wearer's foot and to retain the sandal to the wearer's foot when the stem is received between the wearer's toes.

2. A sandal as claimed in claim 1 adapted to apply an advertising message repeatedly into soil, comprising projections extending from one of the pair of opposing faces and defining a mirror image of the advertising message, the projections being sufficiently large that the advertising message is stamped into the soil as a person wearing the shoe walks over the soil and the stamped message is intelligible to the unassisted human eye at a distance greater than 5 feet.

3. A sandal as claimed in claim 2 in which the advertising message comprises a trademark.

4. A sandal as claimed in claim 2 in which the advertising message comprises letters.

* * * * *